US007987764B2

(12) United States Patent
Kim

(10) Patent No.: US 7,987,764 B2
(45) Date of Patent: Aug. 2, 2011

(54) FLOW CONTROL APPARATUS FOR HEAVY CONSTRUCTION EQUIPMENT

(75) Inventor: Jin Wook Kim, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 510 days.

(21) Appl. No.: 12/204,861

(22) Filed: Sep. 5, 2008

(65) Prior Publication Data

US 2009/0071145 A1 Mar. 19, 2009

(30) Foreign Application Priority Data

Sep. 14, 2007 (KR) ..... 10-2007-0093654

(51) Int. Cl.
*F15B 13/042* (2006.01)

(52) U.S. Cl. ..... 91/446

(58) Field of Classification Search ..... 91/446, 91/448, 468

See application file for complete search history.

(56) References Cited

U.S. PATENT DOCUMENTS

| | | | | |
|---|---|---|---|---|
| 6,691,510 | B2 * | 2/2004 | Kariya et al. | 91/445 |
| 6,742,438 | B2 * | 6/2004 | Kim | 91/445 |
| 6,907,815 | B2 * | 6/2005 | Kim | 91/445 |
| 7,162,946 | B2 * | 1/2007 | Jeon | 91/445 |
| 7,380,489 | B2 * | 6/2008 | Jeon | 91/446 |

* cited by examiner

*Primary Examiner* — Michael Leslie
(74) *Attorney, Agent, or Firm* — Ladas & Parry LLP

(57) ABSTRACT

A flow control apparatus for heavy construction equipment is provided, which can prevent overspeed and abrupt operations of an actuator due to an excessive flow rate during an initial operation of the actuator when a composite work is performed by simultaneously operating an option device and another actuator, and can prevent the cut-off of hydraulic fluid supply to the option device due to an operation inability of a flow control valve when leakage of the hydraulic fluid occurs due to the increase of the temperature of the hydraulic fluid.

2 Claims, 3 Drawing Sheets

FLOW CONTROL APPARATUS FOR HEAVY CONSTRUCTION EQUIPMENT

CROSS-REFERENCE TO RELATED APPLICATION

This application is based on and claims priority from Korean Patent Application No. 10-2007-0093654, filed on Sep. 14, 2007 in the Korean Intellectual Property Office, the disclosure of which is incorporated herein in its entirety by reference.

BACKGROUND OF THE INVENTION

1. Field of the Invention

The present invention relates to a flow control apparatus for heavy construction equipment, which can uniformly supply hydraulic fluid to an actuator, without deteriorating the performance of a hydraulic control valve, in the case where the hydraulic fluid is kept at high temperature and a working device operates on high-load working conditions.

More particularly, the present invention relates to a flow control apparatus for heavy construction equipment, which can prevent overspeed and abrupt operations of an actuator due to an excessive flow rate that exceeds a predetermined flow rate during an initial operation of the actuator when a composite work is performed by simultaneously operating an option device and another actuator, and can prevent the cut-off of hydraulic fluid supply to the option device due to an operation inability of a flow control valve when leakage of the hydraulic fluid occurs due to the increase of the temperature of the hydraulic fluid to a high temperature (that exceeds 90° C.).

2. Description of the Prior Art

As illustrated in FIG. 1, a conventional flow control apparatus for heavy construction equipment includes a hydraulic pump 1; an actuator 13 for option devices connected to the hydraulic pump 1; a variable control spool 12 installed to be shifted by pilot signal pressure in a flow path between the hydraulic pump 1 and the actuator 13; a switching valve 4 installed to be shifted by a difference between pressure in an inlet-side path 5 and pressure in an outlet-side path 6 of the variable control spool 12; and a logic poppet 10 installed to open/close a high-pressure path 2 of the hydraulic pump 1 by a difference between pressure in the high-pressure path 2 and pressure passing through the switching valve 4.

If the variable control spool 12 is shifted by the supply of the pilot signal pressure, the pressure of the inlet-side path 5 becomes relatively higher than that of the outlet-side path 6, and thus the spool of the switching valve 4 is shifted in a right direction as shown in the drawing.

Accordingly, the high-pressure hydraulic fluid fed from the hydraulic pump 1 is supplied to an inlet of a piston orifice 8 via a path 3, the switching valve 4, and a path 7 in order. The hydraulic fluid passing through the piston orifice forms pressure in a back chamber 9, and then is supplied to the inlet-side path 5 of the variable control spool 12 via a poppet path 11 of the logic poppet 10 and an outlet path 3*a* of the logic poppet in order.

In this case, the pressure of the hydraulic fluid fed from the hydraulic pump 1 to the inlet side of the logic poppet 10 via the path 2 is relatively higher than the pressure of the hydraulic fluid fed from the hydraulic pump 1 to the back chamber 9 in which a loss of pressure has occurred via the path 3, the switching valve 4, the path 7, and the piston orifice 8 in order.

Accordingly, the logic poppet 10 is moved in a downward direction as much as a difference between the pressure fed to the inlet side of the logic poppet 10 through the high-pressure path 2 and the pressure fed to the back chamber 9. Thus, the hydraulic fluid fed from the hydraulic pump 1 is supplied to the inlet side of the variable control spool 12 via the path 2, the logic poppet 10, and the outlet path 3*a* of the logic poppet in order.

In this case, a valve spring 18 of the switching valve 4 is set to a predetermined pressure (e.g. 20 kg/cm$^2$), and thus the difference between the pressure of the hydraulic pump side and the pressure of the actuator side can be kept in a predetermined pressure range even if the pressure of the hydraulic pump 1 or the actuator 13 is changed. That is, the flow rate being supplied to the actuator 13 can be controlled by determining the amount of movement of the logic poppet 10, so that the flow rate corresponding to the pressure difference can be supplied.

Accordingly, the logic poppet 10 serves as a flow control valve which uniformly increases the flow rate in accordance with the increment of a sectional area, which corresponds to the movement of the variable control spool 12, on condition of a specified set pressure of the switching valve 4.

On the other hand, in the conventional flow control apparatus for heavy construction equipment as illustrated in FIG. 1, no orifice is provided in the poppet path 11 of the logic poppet 10, and if the logic poppet 10 is opened, damping is not performed to cause the logic poppet 10 to be opened abruptly.

As illustrated in FIG. 4, which is a graph showing a change of pressure in the case where an option device and another actuator are simultaneously operated, if the pilot pressure 23 for option devices is changed in a state that the pressure 21 of the hydraulic fluid fed from the hydraulic pump 1 forms the pressure 22 of the actuator, a peak flow rate 24 of the option device side is simultaneously generated, and then the flow rate is stabilized as a controlled flow rate.

That is, as an excessive flow rate that exceeds a predetermined flow rate is fed during an initial operation of the actuator 13, an abrupt operation of the actuator 13 occurs, and the flow rate fed to another actuator is relatively reduced, resulting in that the flow rate fed to the actuator cannot be stably controlled.

As illustrated in FIG. 2, another conventional flow control apparatus for heavy construction equipment includes a hydraulic pump 1; an actuator 13 for option devices connected to the hydraulic pump 1; a variable control spool 12 installed to be shifted by pilot signal pressure in a flow path between the hydraulic pump 1 and the actuator 13; a switching valve 4 installed to be shifted by a difference between pressure in an inlet-side path 5 and pressure in an outlet-side path 6 of the variable control spool 12; a logic poppet 10 installed to open/close a high-pressure path 2 of the hydraulic pump 1 by a difference between pressure in the high-pressure path 2 and pressure passing through the switching valve 4; a poppet orifice 15 installed in a poppet path 11 to suppress the generation of a peak flow rate during an initial operation of the actuator 13; and a check valve 14 for allowing hydraulic fluid to move from an inlet-side path 5 of the variable control spool 12 to a back chamber 9 (i.e. in one direction).

The construction of this conventional flow control apparatus, except for the damping poppet orifice 15 installed in the poppet path 11 and the check valve 14, is substantially the same as that as illustrated in FIG. 1, thus the detailed description thereof will be omitted. The same drawing reference numerals are used for the same elements across various figures.

As the generation of the peak flow rate is suppressed by the poppet orifice 15 installed in the poppet path 11 during the initial operation of the actuator 13, the overspeed and abrupt operation of the actuator 13 can be prevented.

Also, after the flow rate being fed to the actuator 13 is controlled by the logic poppet 10, a re-seat function of the logic poppet 10 can be improved by the check valve 14 installed inside the logic poppet 10 when the variable control spool 12 is returned.

In the flow control apparatus for heavy construction equipment as illustrated in FIG. 2, if the temperature of the hydraulic fluid is increased above a high temperature (e.g. above 90° C.) due to a long-time use of heavy construction equipment such as an excavator, an excessive leakage of hydraulic fluid occurs due to deterioration of the viscosity of the hydraulic fluid.

That is, due to a difference between the pressure in the high-pressure path 2 and the pressure in the back chamber 9 of the logic poppet 10 that keeps a pressure relatively lower than that of the high-pressure path 2, leakage of the hydraulic fluid occurs through a ring-shaped gap formed on a sliding surface of the logic poppet 10.

In the case of one conventional flow control apparatus of FIG. 1, no poppet orifice is installed, and thus the pressure in the back chamber 9 is easily lowered because of the leakage bypassing through the poppet path 11 even if the leakage of the hydraulic fluid occurs. However, in the case of another conventional flow control apparatus of FIG. 2, the pressure in the back chamber 9 is increased by the poppet orifice 15 installed in the poppet path 11 when the leakage of the hydraulic fluid occurs due to the high temperature of the hydraulic fluid, and thus the logic poppet 10 is seated (in upward direction as shown in the drawing) and do not operate any more.

Accordingly, the supply of the hydraulic fluid from the hydraulic pump 1 to the actuator 13 for option devices is intercepted. That is, in the case where the temperature of the hydraulic fluid is low, the actuator is operated, while in the case where the temperature of the hydraulic fluid is high, the logic poppet 10 is seated due to the increase of the pressure in the back chamber that is caused by the excessive leakage of the hydraulic fluid, and thus the actuator is stopped with the supply of the hydraulic fluid intercepted, thereby lowering the working efficiency of the equipment.

As illustrated in FIG. 5, which is a graph showing a change of pressure in the case where an option device and another actuator are simultaneously operated, if the pilot pressure 23 for option devices is changed in a state that the pressure 21 of the hydraulic fluid fed from the hydraulic pump 1 forms the pressure 22 of the actuator, deterioration of the flow rate 25 of the option device side is simultaneously generated, and then no flow rate is fed to the actuator 13 to cause the operation of the option device to be impossible.

Accordingly, the work is not smoothly performed, and thus the working efficiency is lowered.

SUMMARY OF THE INVENTION

Accordingly, the present invention has been made to solve the above-mentioned problems occurring in the prior art while advantages achieved by the prior art are maintained intact.

One object of the present invention is to provide a flow control apparatus for heavy construction equipment, which can prevent overspeed and abrupt operations of an actuator due to an excessive flow rate exceeding a predetermined flow rate, which is caused by a peak flow rate generated according to a control response delay of a flow control valve, during an initial operation of the actuator when a composite work is performed by simultaneously operating an option device and another actuator.

Another object of the present invention is to provide a flow control apparatus for heavy construction equipment, which can smoothly supply hydraulic fluid to an option device side and thus can improve the reliability and working efficiency by preventing the forming of pressure in a back chamber of a flow control valve when leakage of the hydraulic fluid occurs due to deterioration of the viscosity of the hydraulic fluid, which is caused by the increase of the temperature of the hydraulic fluid to a high temperature (that exceeds 90° C.), during long-time use of the equipment.

In order to accomplish these objects, there is provided a flow control apparatus for heavy construction equipment, according to an embodiment of the present invention, which includes a hydraulic pump; an actuator for option devices connected to the hydraulic pump; a variable control spool installed to be shifted by pilot signal pressure in a flow path between the hydraulic pump and the actuator; a switching valve installed to be shifted by a difference between pressure in an inlet-side path and pressure in an outlet-side path of the variable control spool; a logic poppet installed to open/close a high-pressure path of the hydraulic pump by a difference between pressure in the high-pressure path and pressure passing through the switching valve; a groove formed on a sliding surface of the logic poppet; and a flow path for connecting the groove to an outlet-side path of the logic poppet; wherein, if leakage of hydraulic fluid through a gap formed on the sliding surface of the logic poppet occurs due to an increase of hydraulic fluid fed from the hydraulic pump or an increase of a temperature of the hydraulic fluid to a high temperature, mutual connection between the outlet-side path and a back chamber of the logic poppet is intercepted by the groove and the flow path.

The flow control apparatus for heavy construction equipment according to an embodiment of the present invention may further include a damping poppet orifice installed in a flow path for mutual connection between the back chamber of the logic poppet and the outlet-side path of the logic poppet.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
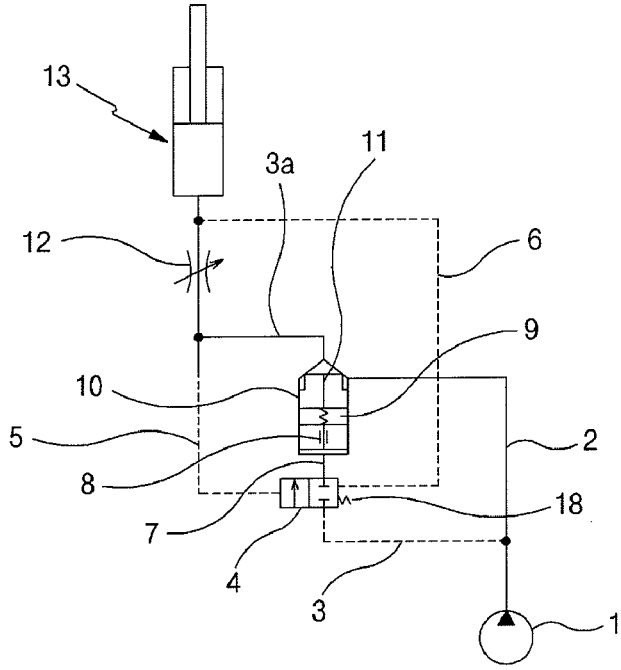
Fig. 1 Prior Art
FIG. 1 is a circuit diagram of one conventional flow control apparatus for heavy construction equipment.
Figure 2:
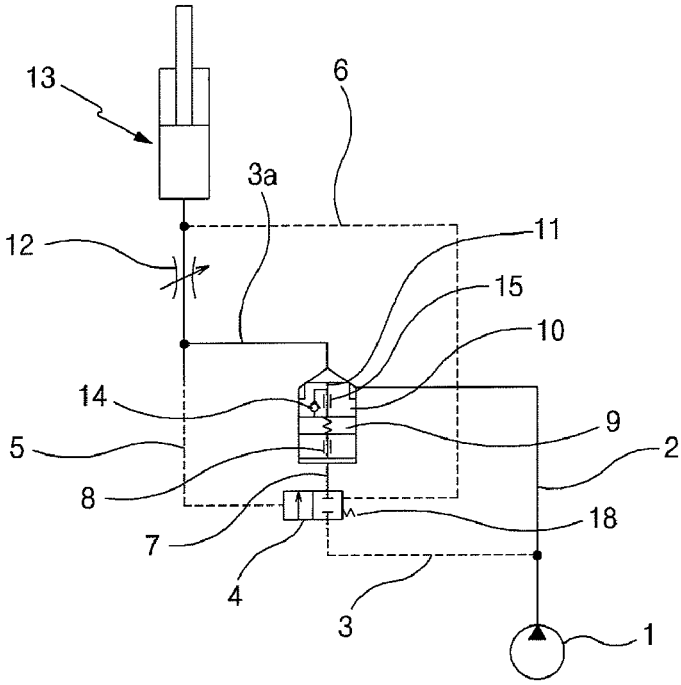
Fig. 2 Prior Art
FIG. 2 is a circuit diagram of another conventional flow control apparatus for heavy construction equipment.
Figure 3:
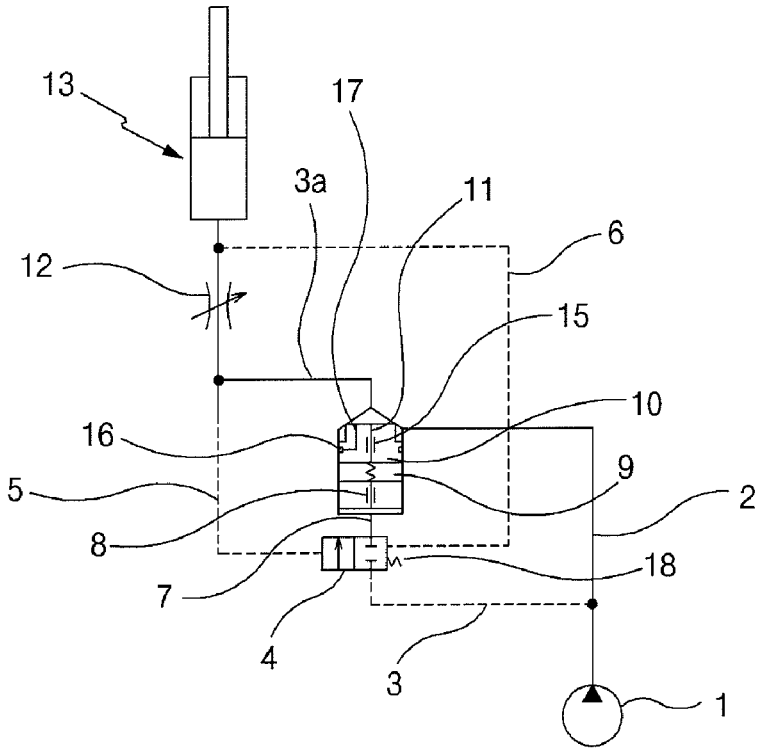
FIG. 3 is a circuit diagram of a flow control apparatus for heavy construction equipment according to an embodiment of the present invention.
Figure 4:
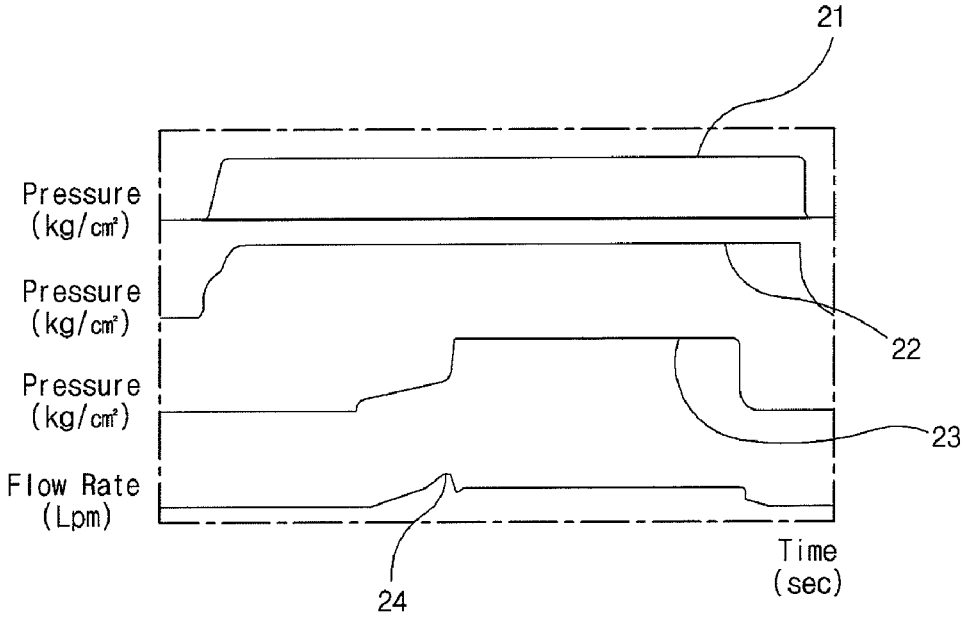
Fig. 4 Prior Art
FIG. 4 is a graph showing a change of flow control according to the hydraulic circuit of FIG. 1.
Figure 5:
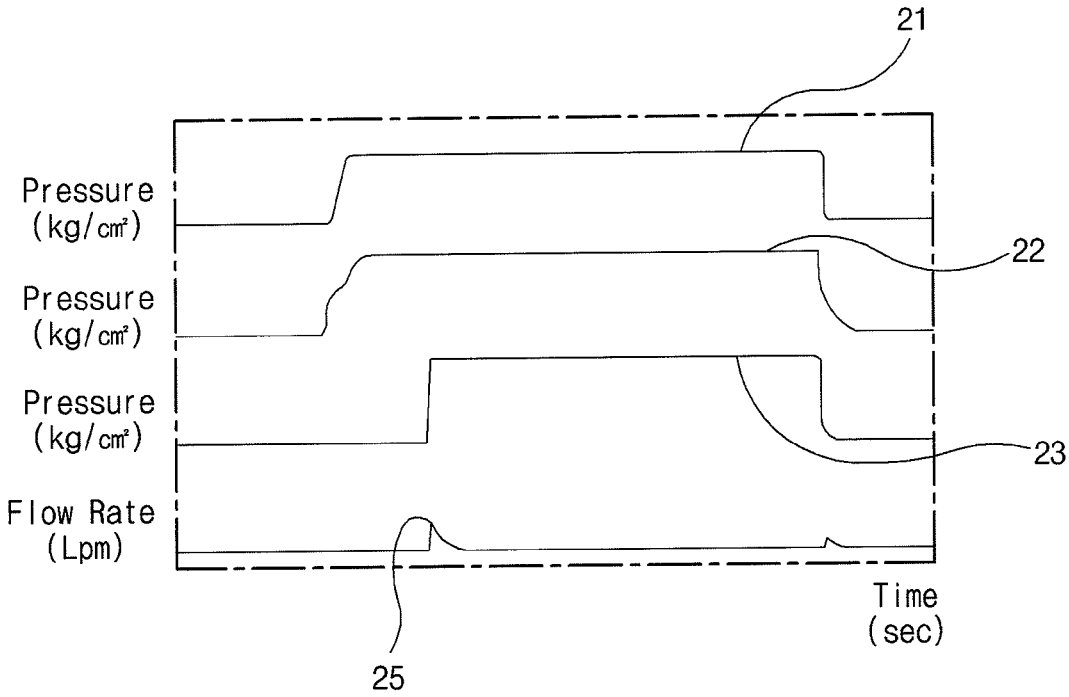
Fig. 5 Prior Art
FIG. 5 is a graph showing a change of flow control according to the hydraulic circuit of FIG. 2.

As illustrated in FIG. 3, a flow control apparatus for heavy construction equipment according to an embodiment of the present invention includes a hydraulic pump 1; an actuator 13 for option devices connected to the hydraulic pump 1; a variable control spool 12 installed to be shifted by pilot signal pressure in a flow path between the hydraulic pump 1 and the actuator 13; a switching valve 4 installed to be shifted by a difference between pressure in an inlet-side path 5 and pressure in an outlet-side path 6 of the variable control spool 12; a logic poppet 10 installed to open/close a high-pressure path 2 of the hydraulic pump 1 by a difference between pressure in the high-pressure path 2 and pressure passing through the switching valve 4; a groove 16 formed on a sliding surface of the logic poppet 10; and a flow path 17 for connecting the groove 16 to an outlet-side path 3*a* of the logic poppet 10.

If leakage of hydraulic fluid through a gap formed on the sliding surface of the logic poppet 10 occurs due to an increase of hydraulic fluid fed from the hydraulic pump 1 or an increase of a temperature of the hydraulic fluid to a high temperature, mutual connection between the outlet-side path 3*a* and a back chamber 9 of the logic poppet 10 is intercepted by the groove 16 and the flow path 17.

The flow control apparatus for heavy construction equipment according to an embodiment of the present invention further includes a damping poppet orifice 15 installed in a flow path 11, which is for mutual connection between the back chamber 9 of the logic poppet and the outlet-side path of the logic poppet, to suppress generation of a peak flow rate during an initial operation of the actuator 13.

Hereinafter, the operation of the flow control apparatus for heavy construction equipment according to an embodiment of the present invention will be described in detail with reference to the accompanying drawings.

As illustrated in FIG. 3, if the variable control spool 12 is shifted by the pilot signal pressure fed from a pilot pump (not illustrated), the pressure of the inlet-side path 5 becomes relatively higher than that of the outlet-side path 6, and thus the spool of the switching valve 4 is shifted in a right direction as shown in the drawing.

Accordingly, the high-pressure hydraulic fluid fed from the hydraulic pump 1 is supplied to an inlet of a piston orifice 8 via a path 3, the switching valve 4, and a path 7 in order. The hydraulic fluid passing through the piston orifice 8 forms pressure in a back chamber 9 through the damping orifice 15, and then is supplied to the inlet-side path 5 of the variable control spool 12 via the poppet path 11 and a path 3*a* of the logic poppet 10 in order.

In this case, the pressure of the hydraulic fluid fed from the hydraulic pump 1 to the inlet side of the logic poppet 10 via the path 2 is relatively higher than the pressure of the hydraulic fluid fed from the hydraulic pump 1 to the back chamber 9 in which a loss of pressure has occurred via the path 3, the switching valve 4, the path 7, and the piston orifice 8 in order.

Accordingly, the logic poppet 10 is moved in a downward direction as much as a difference between the pressure fed from the hydraulic pump 1 to the inlet side of the logic poppet 10 through the high-pressure path 2 and the pressure fed to the back chamber 9. Thus, the hydraulic fluid fed from the hydraulic pump 1 is supplied to the inlet side of the variable control spool 12 via the path 2, the logic poppet 10, and the path 3*a* of the logic poppet 10 in order.

In this case, a valve spring 18 of the switching valve 4 is set to a predetermined pressure (e.g. 20 kg/cm$^2$), and thus the difference between the pressure of the hydraulic pump side and the pressure of the actuator side can be kept in a predetermined pressure range even if the pressure of the hydraulic pump 1 or the actuator 13 is changed. That is, the flow rate being supplied to the actuator 13 can be controlled by determining the amount of movement of the logic poppet 10, so that the flow rate corresponding to the pressure difference can be supplied.

That is, if the pressure in the inlet-side path 5 is lower than a predetermined pressure, the switching valve 4, which is shifted by the difference between the pressure in the inlet-side path 5 and the pressure in the outlet-side path 6 of the variable control spool 12, is kept in a neutral state. The hydraulic fluid fed from the hydraulic pump 1 is supplied to the inlet side of the logic poppet 10 via the path 2, and thus the spool of the switching valve 4 is shifted in a downward direction as shown in the drawing.

Accordingly, the hydraulic fluid fed from the hydraulic pump 1 is supplied to the actuator 13 for option devices through the logic poppet 10 and the variable control spool 12.

By contrast, if the pressure in the inlet-side path 5 is higher than the predetermined pressure, the spool of the switching valve 4 is shifted in a right direction as shown in the drawing, and thus the high-pressure hydraulic fluid fed from the hydraulic pump 1 is supplied to the inlet side of the piston orifice 8 via the path 3, the switching valve 4, and the path 7.

Accordingly, the logic poppet 10 is shifted in a direction of a seat (i.e. seated in an upward direction as shown in the drawing) by the hydraulic fluid passing through the piston orifice, and thus the flow rate being fed to the actuator 13 can be adjusted.

As described above, the logic poppet 10 serves as a flow control valve which uniformly increases the flow rate in accordance with the increment of a sectional area, which corresponds to the movement of the variable control spool 12, on condition of a specified set pressure (e.g. 20 kg/cm$^2$) of the switching valve 4.

On the other hand, if the pressure fed from the hydraulic pump 1 is relatively high and the temperature of the hydraulic fluid is gradually increased, the pressure on the inlet side of the logic poppet 10 is increased to become relatively higher than the pressure of the hydraulic fluid fed to the back chamber 9. Due to this, leakage of the hydraulic fluid may occur through a ring-shaped gap formed on the sliding surface of the logic poppet 10.

In this case, the ring-shaped groove 16 formed on the sliding surface of the logic poppet 10 is connected to the inlet-side path 5 of the variable control spool 12 through the path, and then connected to the path 3*a* that keeps a low pressure. Accordingly, even if the leakage of the hydraulic fluid occurs through the gap on the sliding surface of the logic poppet 10, the forming of back pressure is prevented in the back chamber 9. That is, the mutual connection between the high-pressure path 2 of the hydraulic pump 1 and the back chamber 9 can be prevented.

Accordingly, if the temperature of the hydraulic fluid is increased to a high temperature or high load occurs in the actuator 13, the logic poppet 10 is seated, and thus the interception of the hydraulic fluid being supplied to the actuator 13 for option devices can be prevented.

Also, the damping orifice 15 installed in the path 11 for mutual connection between the back chamber 9 of the logic poppet 10 and the outlet-side path 3*a* of the logic poppet 10 serves to suppress the generation of the peak flow rate during the initial operation of the actuator 13, and improves the re-seat function of the logic poppet 10 during the return of the variable control spool after the flow rate being fed to the actuator 13 is controlled by the logic poppet 10.

Figure 6:
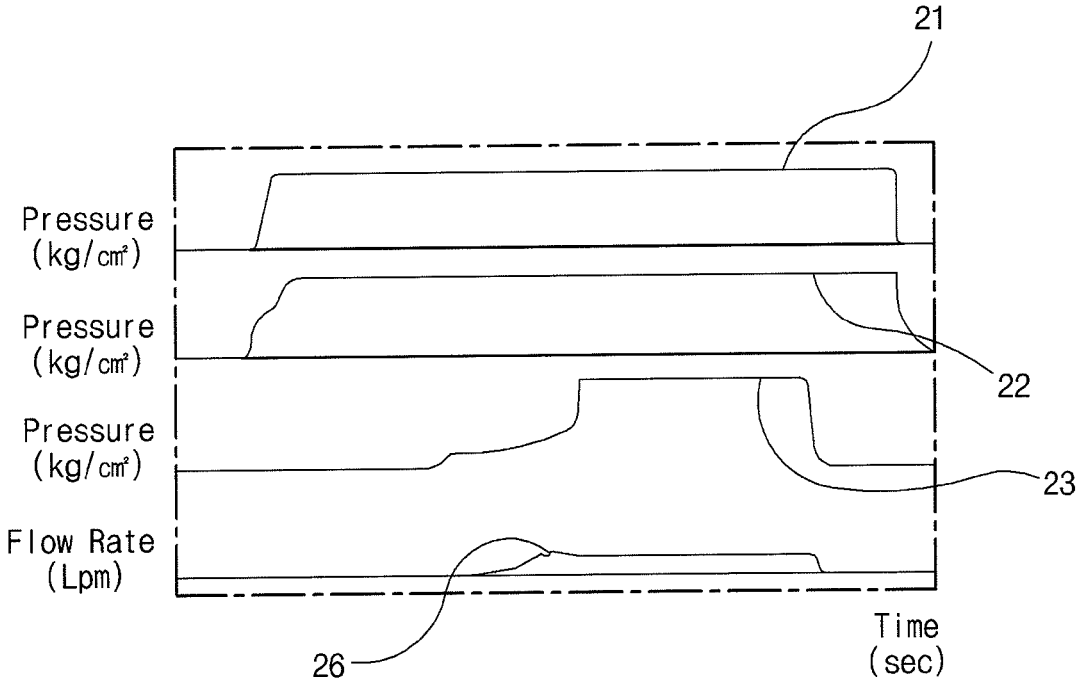
FIG. 6 is a graph showing a change of flow control according to the hydraulic circuit of FIG. 3.

As illustrated in FIG. 6, which is a graph showing a change of pressure in the case where an option device and another actuator are simultaneously operated, if the pilot pressure 23 for option devices is changed in a state that the pressure 21 of the hydraulic fluid fed from the hydraulic pump 1 forms the pressure 22 of the actuator, normal flow rate 26 of the option device side is simultaneously formed. Accordingly, during the initial operation of the actuator, an excessive flow rate that exceeds the predetermined flow rate is not generated, and thus the flow rate being fed to the actuator can be stably controlled.

As described above, the flow control apparatus for heavy construction equipment according to an embodiment of the present invention has the following advantages.

Even if the temperature of the hydraulic fluid is kept high and high load occurs, the flow rate can be uniformly fed to the actuator without deterioration of the performance of the flow control valve (i.e., the logic poppet). Accordingly, the overload and abrupt operations of the actuator due to the supply of an excessive flow rate which is caused by the peak flow rate generated during the initial operation of the actuator can be prevented, and thus stability, reliability, and workability of the equipment can be improved.

Also, in the case where the leakage of the hydraulic fluid occurs due to deterioration of the viscosity of the hydraulic fluid, which is caused by the increase of the temperature of the hydraulic fluid to a high temperature during the long-time use of the equipment, the back pressure is prevented from being formed in the back chamber of the flow control valve, and thus the hydraulic fluid can be smoothly supplied to the option device to improve the reliability and working efficiency of the equipment.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A flow control apparatus for heavy construction equipment, comprising:

a hydraulic pump;

an actuator for option devices connected to the hydraulic pump;

a variable control spool installed to be shifted by pilot signal pressure in a flow path between the hydraulic pump and the actuator;

a switching valve installed to be shifted by a difference between pressure in an inlet-side path and pressure in an outlet-side path of the variable control spool;

a logic poppet installed to open/close a high-pressure path of the hydraulic pump by a difference between pressure in the high-pressure path and pressure passing through the switching valve;

a groove formed on a sliding surface of the logic poppet; and a flow path for connecting the groove to an outlet-side path of the logic poppet;

wherein, if leakage of hydraulic fluid through a gap formed on the sliding surface of the logic poppet occurs due to an increase of hydraulic fluid fed from the hydraulic pump or an increase of a temperature of the hydraulic fluid to a high temperature, mutual connection between the outlet-side path and a back chamber of the logic poppet is intercepted by the groove and the flow path.

2. The flow control apparatus of claim 1, further comprising a damping poppet orifice installed in a flow path for mutual connection between the back chamber of the logic poppet and the outlet-side path of the logic poppet.

* * * * *